US007703546B2

(12) United States Patent
Kettner

(10) Patent No.: US 7,703,546 B2
(45) Date of Patent: Apr. 27, 2010

(54) PULSE TOOL AND ASSOCIATED FRONT PLATE

(75) Inventor: Konrad Karl Kettner, Aalen (DE)

(73) Assignee: Cooper Power Tools GmbH & Co., Westhausen (DE)

( * ) Notice: Subject to any disclaimer, the term of this patent is extended or adjusted under 35 U.S.C. 154(b) by 4 days.

(21) Appl. No.: 11/939,274

(22) Filed: Nov. 13, 2007

(65) Prior Publication Data

US 2009/0008117 A1 Jan. 8, 2009

(30) Foreign Application Priority Data

Nov. 13, 2006 (EP) ..... 06023567

(51) Int. Cl.
*B25B 25/02* (2006.01)

(52) U.S. Cl. ..... 173/93; 173/93.5; 173/208

(58) Field of Classification Search ..... 173/93, 173/93.5, 93.6, 208

See application file for complete search history.

(56) References Cited

U.S. PATENT DOCUMENTS

| | | | | |
|---|---|---|---|---|
| 4,836,296 | A * | 6/1989 | Biek | 173/93.5 |
| 4,967,852 | A * | 11/1990 | Tatsuno | 173/93 |
| 5,080,181 | A * | 1/1992 | Tatsuno | 173/93.5 |
| 5,611,404 | A | 3/1997 | Biek et al. | |
| 6,059,049 | A * | 5/2000 | Lin | 173/93.5 |
| 6,217,306 | B1 * | 4/2001 | Seward et al. | 418/270 |
| 6,241,500 | B1 * | 6/2001 | Ellis | 418/270 |
| 6,334,494 | B1 | 1/2002 | Nagato | |
| 6,505,690 | B2 * | 1/2003 | Tokunaga | 173/93.5 |
| 6,796,386 | B2 * | 9/2004 | Izumisawa et al. | 173/93.5 |
| 6,863,134 | B2 | 3/2005 | Seith et al. | |
| 6,883,617 | B2 | 4/2005 | Putney et al. | |
| 7,484,569 | B2 | 2/2009 | Kettner | |
| 2008/0110656 | A1 | 5/2008 | Kettner | |

FOREIGN PATENT DOCUMENTS

| | | | |
|---|---|---|---|
| DE | 20210453 | U1 | 11/2003 |
| EP | 0187129 | A2 | 7/1986 |
| EP | 0465450 | A2 | 1/1992 |

* cited by examiner

*Primary Examiner*—Scott A. Smith
(74) *Attorney, Agent, or Firm*—King & Spalding LLP

(57) ABSTRACT

A pulse tool, in particular a pulse nutsetter, has a drive unit and a pulse unit driven by it. The pulse unit has at least one rotor with at least two vanes, a hydraulic cylinder surrounding it and a drive spindle protruding at one end out of the hydraulic cylinder through a front plate. The front plate is arranged between the rotor and a front cover, the cover being formed with a hydraulic fluid filling device. In order to improve a pulse tool of this nature, in that deviations from the desired pulse frequencies can be compensated in a simple manner and in particular already during the assembly of the pulse tool, the front plate has at least one bypass opening connecting the high-pressure and low-pressure chambers which are separated by the vanes. The pulse tool may also include an appropriate front plate.

21 Claims, 3 Drawing Sheets

PULSE TOOL AND ASSOCIATED FRONT PLATE

Figure 1:
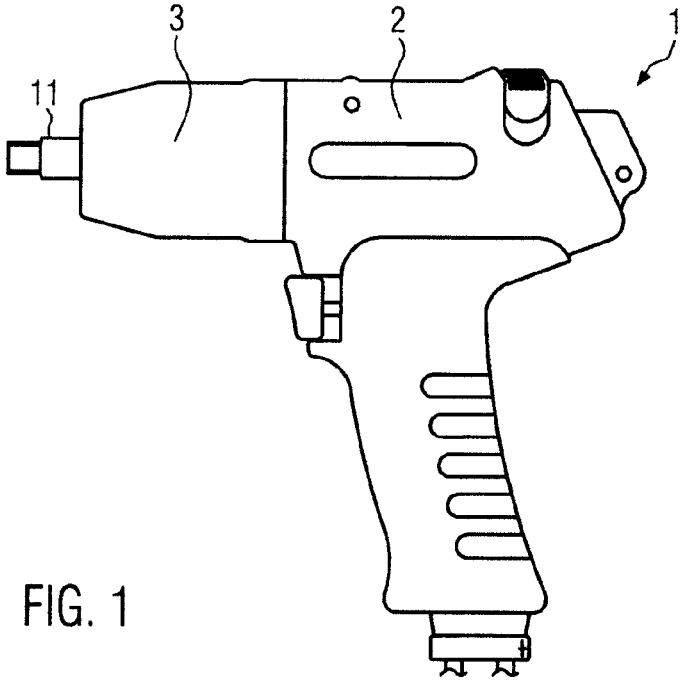

The invention relates to a pulse tool, in particular a pulse nutsetter, with a drive unit and a pulse unit driven by it, the said pulse unit having at least one rotor with at least two vanes, a hydraulic cylinder surrounding it and a drive spindle protruding at one end out of the hydraulic cylinder through a front plate. The front plate is arranged between the rotor and a front cover of the pulse unit, said cover being formed with a hydraulic fluid filling device.

A pulse tool of this nature is known from practice and, by means of the drive spindle and an appropriate tool on the drive spindle, it is used, for example, to carry out screwed joint operations. The speed of a screwed joint operation of this nature essentially determines the efficiency of the pulse tool. The faster the screwed joint operation occurs, the higher the efficiency. With hard screwed joints with a small tightening angle this is generally not a problem. However, if the screwed joint is softer, then the pulse tool can take a few seconds to establish the required screwed joint. A time period of this length is generally not acceptable. In order to ensure efficient screwed joint operations in every case, pulse frequencies between 20 Hz and 30 Hz are preferred.

During the production of appropriate pulse tools it has been found that the pulse frequency can vary within a certain scope and in comparison to the pulse frequencies quoted above can be quite a few Hz higher or lower.

The object of the invention is to compensate the corresponding deviations at the desired pulse frequencies in a simple manner and in particular already during the assembly of the pulse tool.

The object is solved by the features of Patent Claim 1.

According to the invention the front plate of the pulse tool has at least one bypass opening linking the high-pressure and low-pressure chambers which are separated by the vanes.

Through opening or closing the bypass opening, the pulse frequency can be appropriately increased or decreased, wherein with the bypass opening open hydraulic fluid can flow out of the high-pressure chamber into the low-pressure chamber, by means of which the pulse frequency is increased. The corresponding increase in the pulse frequency here depends in particular on the opening diameter of the corresponding bypass opening, wherein with a larger opening diameter a faster interchange of hydraulic fluid can occur between the above mentioned chambers and thus a faster travel over the corresponding hydraulic cylinder sealing webs by the corresponding vanes can occur.

Analogously, the pulse frequency can be reduced by closing the bypass opening.

Principally, there is the possibility that a corresponding bypass opening is formed in the front plate only after an initial test of the pulse tool with regard to the appropriate pulse frequency. Depending on the desired change of pulse frequency, the bypass opening is provided with the corresponding opening diameter. There is also the possibility of at least partially closing an existing bypass opening to appropriately change the pulse frequency, or however of varying the opening diameter of the bypass opening. For example, the opening diameter could be enlarged if a corresponding increase in the pulse frequency is desired.

A simple method of closing and correspondingly opening the bypass opening can be conceived if it can be closed by means of an, in particular spherical, closing body arranged between a front plate and a front cover. Depending on the desired change in the pulse frequency, the corresponding closing body is removed or used for closing the bypass opening.

With only one bypass opening only relatively few variations in the pulse frequency are possible. For example, by opening and closing a bypass opening, the pulse frequency can be increased or decreased by a few Hz. If more variations of the pulse frequency are desired, two or more bypass-openings can be formed by a bypass-opening group. These bypass openings of the bypass opening group can then be used for appropriately changing the pulse frequency by opening or closing one or more bypass openings. In this case a bypass opening group links corresponding high-pressure and low-pressure chambers of the pulse unit. This means that all bypass openings of the bypass opening group can be used for the appropriate interchange of hydraulic fluid between the chambers in any combination. If, for example, a bypass opening group of this nature consists of three bypass openings, then it is obvious that one, two or all three bypass openings can be opened or correspondingly closed by associated closing bodies.

If, for example four or also more vanes are used for the pulse unit, then also correspondingly two or more high-pressure and low-pressure chambers are in each case separated by them in pairs. Furthermore, it can be of advantage in this connection, if bypass opening groups are arranged in pairs diametrically opposed to one another. Here, an arrangement occurs such that in each case a bypass opening group is assigned to a high-pressure chamber, wherein each high-pressure chamber can have its own assigned bypass opening group.

There is the possibility that the corresponding opening diameters of the bypass openings of each bypass opening group are equally large. Similarly it is conceivable that the opening diameters of each bypass opening of a bypass opening group are different. This means that for example the bypass opening with the largest opening diameter is closed alone in order to facilitate a certain increase in pulse frequency, whereas on opening the bypass opening with the smallest opening diameter a lower increase in pulse frequency is realised. On the other hand appropriate combinations of opening or closing all bypass openings of a bypass opening group are possible.

Generally, a pulse tool as described above is not designed for just one direction of rotation, but for right and left rotation. In order to be able to appropriately change the pulse frequency for both directions of rotation, bypass opening groups can be arranged for right and left rotation of the drive spindle. The arrangement of the bypass opening groups, the number of bypass openings in each bypass opening group and the diameter of each bypass opening can be varied in line with the above.

There is the possibility that an appropriate bypass opening group is assigned to each high-pressure chamber, wherein similarly it can also be sufficient if only one or two of the high-pressure chambers have a corresponding bypass opening group assigned to them.

In order to be able to appropriately close each of the bypass openings through just one type of closing body, it is certainly favourable if the closing bodies each have the same diameter for all bypass openings. This can in particular be implemented in that each bypass opening has an appropriately formed sealing seat for the closing body in the direction of the front cover, wherein the sealing seat can be formed by an essentially conical extension of the bypass opening. This conical extension can be identical for all bypass openings, so that corresponding closing bodies with the same diameter or the same dimensions can be used.

The pulse tool is filled with hydraulic fluid before shipment to the user, wherein the filling generally occurs directly at the pulse unit. To achieve this, an appropriate hydraulic fluid filling device is used. In order to facilitate filling the pulse unit with hydraulic fluid in a simple manner, the hydraulic fluid filling device on the cover has at least one in particular closable filling opening. The pulse unit is filled through this opening with hydraulic fluid under a vacuum and in particular with a filling of this nature it is ensured that no bubbles remain within the pulse unit.

After filling the pulse unit it can then be assembled into the pulse tool and can be joined to the appropriate drive unit. Before this, the filling opening is closed off appropriately for example by a screw-in sealing pin or piston and optionally a closing body.

Advantageously, the filling opening can be aligned relatively to each bypass opening, so that the corresponding closing bodies for the bypass openings can be inserted and removed through the filling opening.

With regard to the opening diameters of the corresponding bypass openings of each bypass opening group it should be noted that for right and left rotation these can change in the reverse direction for the corresponding bypass opening group.

As already described, the pulse frequency can be varied through the bypass openings and the pulse tool can be supplied with a certain basic pulse frequency. However, there is the possibility when using the pulse tool that this basic pulse frequency changes, for example due to leakage losses of hydraulic fluid or temperature changes of the hydraulic fluid causing pressure changes, etc. In order to also facilitate matching of the basic frequency with regard to these effects during operation, the pulse unit can have a fluid opening connected to a compensation chamber at its end opposite the drive spindle. The compensation chamber can vary in volume, i.e. compensating volume, for the compensation of the above effects. A variation of this nature can for example occur using an elastic membrane to bound the compensation chamber. The elastic membrane is deflected when the hydraulic fluid assumes a larger volume at high temperatures so that the corresponding extra volume is accepted by the compensation chamber through deflection of the membrane and in this way the basic pulse frequency is maintained unchanged. If the hydraulic fluid cools down, the hydraulic fluid is returned to the pulse unit from the compensation chamber via the corresponding fluid opening.

Furthermore, it is advantageous in this connection if the corresponding compensation chamber can be varied in its compensation volume not only dependent on pressure, but instead independently of the pressure. In this way there is the possibility for example that with a first filling of the pulse unit with hydraulic fluid a larger compensating volume is provided which can in particular compensate in a simple manner for appropriate leakages with continued use of the pulse unit.

A simple possibility for a pressure-independent variable compensating volume of this nature can be conceived if the compensation chamber is bounded by the hydraulic cylinder and a compensating piston which can in particular be adjusted through rotation in the longitudinal direction. The compensating piston can be rotatable by the worker from outside so that the appropriate adjustment of the compensating volume can be undertaken by the worker before, during or even after using the pulse tool.

In order to be able to fix the appropriate compensating piston in a desired rotary position in a simple manner, the compensating piston can be fixed in at least one rotary position relative to the hydraulic cylinder by means of a fixing device.

The invention also relates to an appropriate front plate of the type previously described, which can be employed with an appropriate pulse tool between the pulse unit and the front cover. A front plate of this nature has the appropriate bypass openings or bypass opening groups and can optionally also be used as a retrofitted component on pulse tools already in use.

In the following the invention will be explained and described in more detail based on figures included in the drawing.

Figure 2:
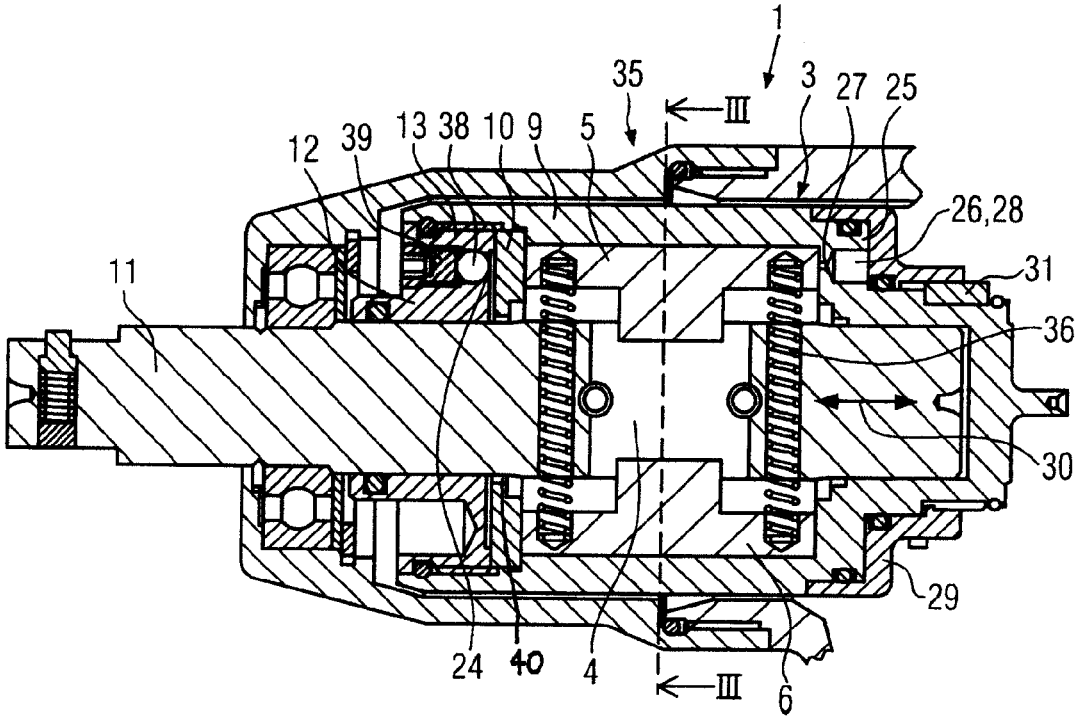
Figure 3:
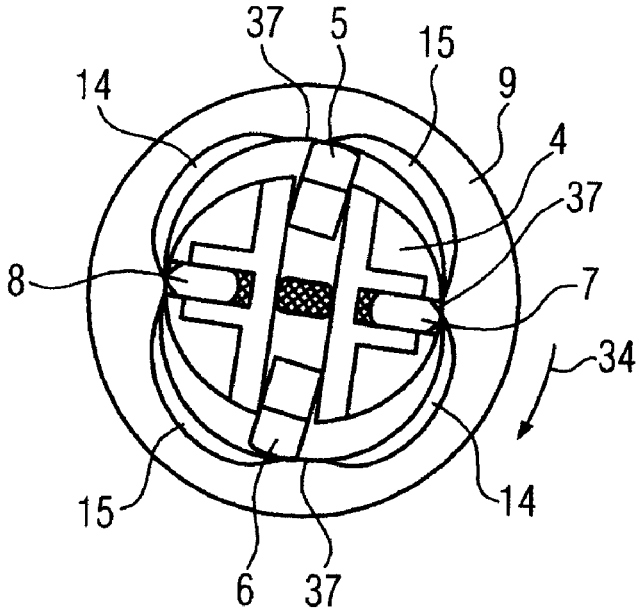
Figure 4:
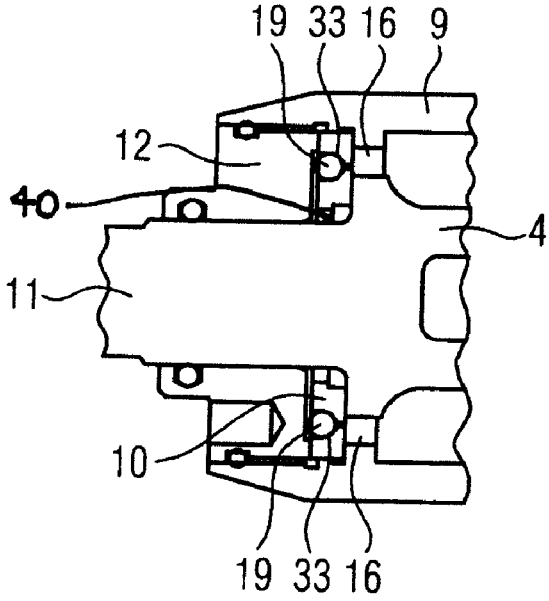
Figure 5:
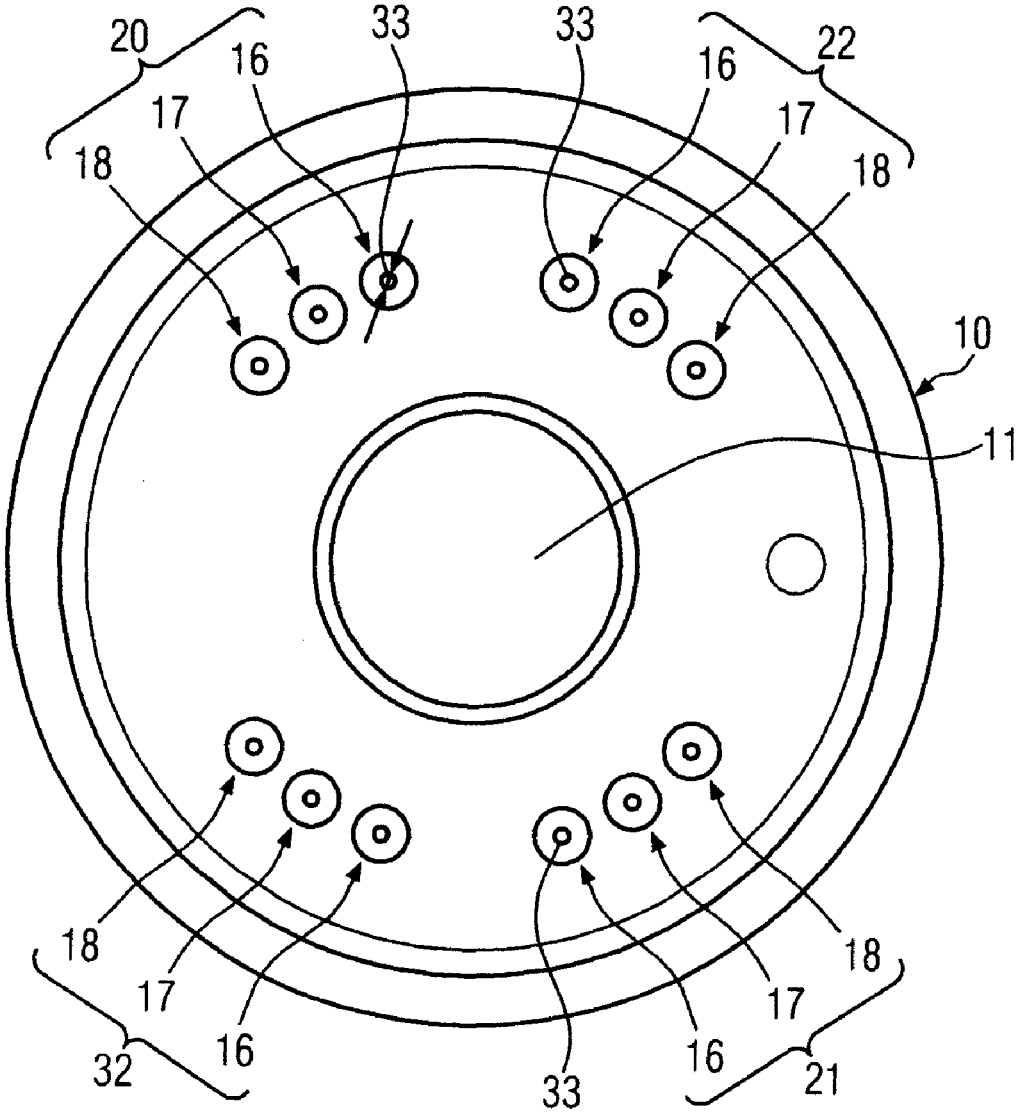

The following are shown:

FIG. 1 a side view of a pulse tool with at least a drive unit and pulse unit;

FIG. 2 a longitudinal section through a pulse unit with drive spindle;

FIG. 3 a section along the line III-III of an appropriate pulse unit (from FIG. 2);

FIG. 4 a detailed illustration of a front end of the pulse unit according to FIG. 2 and FIG. 5 a front view of a front plate according to FIG. 4.

FIG. 1 illustrates a side view of a pulse tool 1 with at least one drive unit 2 and one pulse unit 3. From the pulse unit 3 a drive spindle 11 protrudes to which an appropriate tool, for example for a screwed joint, can be fitted, such as a socket or similar tool.

Generally, a pulse tool of this nature is equipped with a pneumatic motor as drive unit and can generally be operated with right and left rotation for tightening and also for loosening a screwed joint.

In FIG. 2 in particular the pulse unit 3 according to FIG. 1 is illustrated in a longitudinal section. The pulse unit 3 is arranged in a housing 35 which is constructed optionally in a number of parts. The pulse unit 3 has a rotor 4 which is connected for being driven by the drive unit 2. In the rotor 4 radially adjustable vanes 5, 6, 7 and 8 are supported, refer also to FIG. 3. In each case two diametrically opposed vanes 5, 6 or 7, 8 are subjected to radial outward pressure by appropriate compression springs 36. The free ends of the vanes 5, 6, 7, 8 contact an internal contour of a hydraulic cylinder 9 in the region of sealing webs 37, refer also to FIG. 3, wherein they separate the high and low-pressure chambers 14, 15 from one another. The rotor, vanes, sealing webs and hydraulic cylinder interact in the normal way to produce pulse impacts at a certain pulse frequency. Generally the pulse frequency is 20 to 30 Hz, because at a pulse frequency of this nature efficient screwed joint operations are ensured.

The pulse unit 3 has a front plate 10 and a front cover 12 at its end situated to the left in FIG. 2. The front plate 10 is arranged between essentially the rotor 4 or vanes 5, 6, 7, 8 and the front cover 12. A hydraulic fluid filling device 13 is arranged in the front cover 12. This comprises at least one filling opening 24, which can be closed by a closing ball and a screw-in sealing pin or piston 38 and 39 after filling the pulse unit 3 with hydraulic fluid.

The pulse unit is on the end of the drive spindle 11 sealed by the front cover 12 so that hydraulic fluid can be interchanged between the high-pressure and low-pressure chambers via sealing gaps between the front plate 10, the front cover 12 and the rotor 4 or vanes 5, 6, 7, 8.

The drive spindle 11 passes through both the front plate 10 as well as the front cover 12 and protrudes out of the pulse tool 1 for the arrangement of an appropriate tool.

At its end 25 situated opposite the drive spindle 1 the pulse unit 3 has a fluid opening 27 in the hydraulic cylinder. This opening connects the chambers 14, 15, refer also to FIG. 3, inside the pulse unit 3 with a compensation chamber 26 with a corresponding compensating volume 28. This compensation chamber 26 is bounded by the hydraulic cylinder 9 and a compensating piston 29 which is adjustable by rotation in the longitudinal direction 30.

In the position illustrated in FIG. 2 the compensating piston 29 is rotated as far as possible in the direction of the hydraulic cylinder 9 such that the corresponding compensation chamber 26 is essentially formed only by the cylindrical chamber illustrated in FIG. 2.

The compensating piston 29 can be adjusted to the right relative to the hydraulic cylinder 9 in FIG. 2, by means of which the compensation chamber 26 receives a larger compensating volume 28. Certain rotary positions of the compensating piston 29 can be fixed by a pin as a fixing device 31, whereby for example four, six or even more rotary positions can be appropriately fixed with the rotation of the compensating piston 29.

In FIG. 3 a section along the line III-III from FIG. 2 is illustrated. Here in particular, the arrangement of the high-pressure chambers 14 and low-pressure chambers 15 between in each case two vanes 5, 6, 7 or 8 can be seen. These are radially supported in the rotor 4 for outward adjustment and have pressure applied by compression springs. In the position illustrated in FIG. 3 two high-pressure chambers 14 and two low-pressure chambers 15 are in each case located diametrically opposed to one another, wherein the corresponding vanes 5, 6, 7, 8 are still just in sealing contact with the corresponding sealing webs 37. The direction of rotation according to FIG. 3 is indicated by the reference numeral 34, wherein in this connection right rotation of the rotor or corresponding to the drive spindle 11 occurs, refer also to FIG. 2.

In FIG. 4 a detailed illustration of the pulse unit 3 is shown, in particular for the front plate 10 and the front cover 12. In the front plate it is possible to see the bypass openings 16 and closing bodies 19 in the form of closing balls which close these bypass openings. The closing balls 19 are held between the front plate 10 and the front cover 12. The bypass openings are connected to the corresponding chambers inside the pulse unit 3. Each bypass opening 16, 17, 18, refer also to FIG. 5, has in the direction of the front cover 12 a receptacle seat 33 for the arrangement of the corresponding closing ball 19. The receptacle seats 33 have the same cross-section for all bypass openings so that each of the bypass openings 16, 17, 18 can be closed by a closing ball 19 with the same diameter. Each receptacle seat 33 has as cross-section essentially a conical part which extends from a corresponding opening diameter 23 of the bypass openings and an essentially cylindrical part connected to it. The closing ball 19 is in sealing contact with the conical part.

The opening diameters 23 of the different bypass openings 16, 17 18 are different, refer in particular to FIG. 5.

The corresponding bypass openings 16, 17, 18 have been combined as in FIG. 5 to bypass openings 20, 32, 22 and 32. The bypass opening groups 20 and 21 are in connection with the corresponding high-pressure chambers 14 as in FIG. 3, wherein an analogous connection through the bypass opening groups 22 and 32 with the high-pressure chambers occurs with reverse running, i.e. with left rotation according to FIG. 3.

With the embodiment according to FIG. 5 each bypass opening group has three bypass openings 16, 17, 18. The arrangement of the bypass openings 16, 17, 18 occurs for the bypass opening groups 20 and 21 in the same direction and in the reverse direction for the bypass opening groups 22 and 32. The different bypass openings 16, 17, 18 have in this order a reducing opening diameter 23. This means that the two bypass openings 16 have the largest opening diameter and the bypass opening 18 the smallest.

The bypass opening groups 20, 21 and 22, 32 are arranged diametrically opposed to one another and are assigned to the respective high-pressure chambers. Hydraulic fluid enters the low-pressure chambers through the bypass openings 16, 17, 18 left unclosed by the closing balls 19 and it primarily flows via the centre 40 of the front plate to its left side as in FIG. 4 from the direction of the high-pressure chambers so that an interchange of hydraulic fluid occurs in this way between the chambers, thus leading to a faster travel over the sealing webs of the hydraulic cylinder by the vanes and an increase in the pulse frequency. A greater or reduced interchange of hydraulic fluid occurs depending on the opened bypass opening. For the three illustrated bypass openings 16, 17, 18 of each bypass opening group 20 with correspondingly different opening diameters, $2^3$ possible settings of the hydraulic fluid interchange arise in this way due to the corresponding opened bypass openings. In this way a pulse frequency for setting an appropriate basic pulse frequency can be varied eight times by certain amounts. The appropriate basic pulse frequency is adjusted before shipment of the pulse tool, in particular in the range from 20 Hz to 30 Hz. The appropriate opening diameters of the bypass openings 16, 17, 18 can be in the range of a few tenths of a millimeter. There is also the possibility of arranging fewer or more bypass openings for each bypass opening group so that in this way appropriately fewer or more possible settings arise for the basic pulse frequency. Generally with the use of the pulse unit for right and left rotation a symmetrical assignment of the bypass openings with or without closing bodies is practicable. In this way the same pulse frequency is produced in both directions of rotation with the analogous arrangement of the closing bodies. However, it is also possible to provide different arrangements of bypass openings and/or bypass opening groups for right and left rotation in order for example to provide one direction of impact with significantly more possible frequencies than the other.

Closure of the bypass opening groups 20, 21 during right rotation 34 according to FIG. 3, i.e. with the assignment of the bypass opening groups 22, 32 to the high-pressure chambers, is not required due to the pressure neutrality between the front and rear sides of the front plate 10. It is again pointed out that always only those bypass openings are effective which are connected to the low-pressure chamber or to the low-pressure end. The low-pressure chamber changes when the direction of rotation changes. Pressure in both directions of rotation is primarily applied via the centre 40 onto the left side of the front plate 10, refer for example to FIG. 4, wherein the bypass openings on the pressure side or in assignment to the pressure chamber 14 with or without closing bodies are pressure neutral and thus ineffective.

The arrangement of the closing bodies 19 in the corresponding receptacle seats 33 occurs through the filling opening 24, wherein the front cover 12 can be rotated according to the assignment of the filling opening 24 to each of the bypass openings 16, 17, 18.

An appropriate front plate 10 can also generally be retrofitted for pulse tools already in use, refer in particular to FIGS. 2 and 4, wherein only the corresponding previously used front plate needs to be replaced by the front plate according to the invention.

The invention claimed is:

1. Pulse tool (1), in particular a pulse nutsetter, with a drive unit (2) and a pulse unit (3) driven by the drive unit (2), said pulse unit having at least one rotor (4) with at least two vanes (5, 6, 7, 8), a hydraulic cylinder (9) surrounding the rotor (4)

and a drive spindle (11) which protrudes at one end out of the hydraulic cylinder through a front plate (10), wherein the front plate (10) is arranged between the rotor (4) and a front cover (12) formed with a hydraulic fluid filling device (13), characterised in that the front plate (10) has at least one bypass opening (16, 17, 18) connecting a high-pressure and a low-pressure chamber (14, 15) which are separated by the vanes (5, 6, 7, 8), wherein two or more bypass openings (16, 17, 18) form a bypass opening group (20, 21, 22, 32), and wherein the opening diameters (23) of each bypass opening (16, 17, 18) of a bypass opening group (20, 21, 22, 32) are different.

2. Pulse tool according to claim 1, characterised in that the bypass opening (16, 17, 18) is closed.

3. Pulse tool according to claim 1 or 2, characterised in that the bypass opening (16, 17, 18) is closed by means of a closing body (19) arranged between the front plate (10) and the front cover (12).

4. Pulse tool according to claim 3, characterised in that the closing bodies (19) for each bypass opening have the same diameter.

5. Pulse tool according to claim 3, characterised in that the closing body (19) is substantially spherical.

6. Pulse tool according to claim 1, characterised in that the bypass opening groups (20, 21, 22, 32) are arranged in pairs in the front plate (10) diametrically opposite one another.

7. Pulse tool according to claim 1, characterised in that bypass opening groups (20, 21, 22, 32) are arranged for the right and left rotation of the drive spindle (11).

8. Pulse tool according to claim 1, characterised in that a bypass opening group (20, 21, 22, 32) is assigned to each high-pressure chamber (14).

9. Pulse tool according to claim 1, characterised in that the hydraulic fluid filling device (13) has at least one, in particular closable, filling opening (24) in the front cover (12).

10. Pulse tool according to claim 9, characterised in that the filling opening (24) can be aligned relative to each bypass opening (16, 17, 18).

11. Pulse tool according to claim 1, characterised in that the opening diameters (23) for the bypass opening groups (20, 21, 22, 32) change in the reverse order for right or left rotation.

12. Pulse tool according to claim 1, characterised in that the pulse unit (3) has at its end (25) opposite the drive spindle (11) a fluid opening (27) connected to a compensation chamber (26).

13. Pulse tool according to claim 12, characterised in that the compensation chamber (26) has a pressure-independently variable compensating volume (28).

14. Pulse tool according to claim 12, characterised in that the compensation chamber (26) is bounded by the hydraulic cylinder (9) and a compensating piston (29) which is adjustable, in particular by rotation in the longitudinal direction (30).

15. Pulse tool according to claim 14, characterised in that the compensating piston (29) can be fixed in at least one rotary position relative to the hydraulic cylinder (9) by means of a fixing device (31).

16. Pulse tool according to claim 1, characterised in that each bypass opening (16, 17, 18) comprises a different opening diameter (23).

17. Front plate (10) for a pulse tool (1), said front plate (10) adapted to be positioned between a pulse unit (3) and a front cover (12) in the pulse tool (1), characterised in that the front plate (10) has at least one bypass opening (16, 17, 18) for the connection of a high-pressure and low-pressure chamber (14, 15) of the pulse unit (3), and characterised in that each of the bypass openings (16, 17, 18) of each bypass opening group (20, 21, 22, 32) comprises a different opening diameter (23).

18. Front plate according to claim 17, characterised in that two or more bypass openings (16, 17, 18) are arranged in a bypass opening group (20, 21, 22, 32).

19. Front plate according to claim 18, characterised in that the bypass opening groups (20, 21, 22, 32) are arranged in pairs diametrically opposite one another.

20. Front plate according to claim 17, characterised in that each bypass opening (16, 17, 18) has in the direction of the front cover (12) an approximately conically extended receptacle seat for a closing body (19) for closing the bypass opening (16, 17, 18).

21. Front plate according to claim 20, characterised in that the receptacle seat (33) essentially has the same cross-section for all the bypass openings (16, 17, 18).

* * * * *